US005253230A

United States Patent [19]

Kuo

[11] Patent Number: 5,253,230

[45] Date of Patent: Oct. 12, 1993

[54] ALARM CLOCK WITH AN SWITCH BUTTON ASSEMBLY

[76] Inventor: Davis Kuo, No. 4, Shin-Ho Rd., Tainan City, Taiwan

[21] Appl. No.: 924,975

[22] Filed: Aug. 5, 1992

[51] Int. Cl.[5] ..... G04B 23/00

[52] U.S. Cl. ..... 368/263; 365/262; 365/243

[58] Field of Search ..... 368/262, 263, 250-261, 368/264-269, 248-249

[56] References Cited

U.S. PATENT DOCUMENTS

| | | | |
|---|---|---|---|
| 2,488,637 | 11/1949 | Moss | 368/263 |
| 3,264,817 | 8/1966 | Beguin | 368/263 |
| 3,517,499 | 6/1970 | Keane, Jr. et al. | 368/263 |
| 4,423,966 | 1/1984 | Ogihara et al. | 368/263 |
| 4,799,204 | 1/1989 | Kitaoka et al. | 368/263 |
| 5,077,707 | 12/1991 | Kuo | 368/74 |
| 5,177,716 | 1/1993 | Kuo | 368/262 |

*Primary Examiner*—Bernard Roskoski

*Attorney, Agent, or Firm*—Cushman, Darby & Cushman

[57] ABSTRACT

A casing includes an elongated opening, an alarm device having a buzzer, a battery unit and a circuit unit to connect the battery unit to the buzzer, a time setting wheel and a conductive plate which has a first end connected to a first terminal of the battery unit, a second end abutting with the time setting wheel, a third end connected to a first contact point of the circuit board, and a fourth end above a second contact point of the circuit unit. The alarm device is actuated by a switch button assembly that includes a lever, which is made of a resilient, insulative material, pivotally mounted in the elongated opening and having a first end and a second end transversely passing the elongated opening to extend out of the casing. The first end of the lever includes an insertion piece, which can be inserted between the third end of the conductive plate and the first contact point of the circuit board to disconnect the same so as to stop the generation of alarm signal when the lever is moved in the elongated opening, and a pressing portion, which presses the conductive plate to actuate a snooze circuit when the lever is pivoted in the elongated opening. The inner peripheral edge of the elongated opening serves as fulcrum for the lever.

4 Claims, 7 Drawing Sheets

ALARM CLOCK WITH AN SWITCH BUTTON ASSEMBLY

BACKGROUND OF THE INVENTION

1. FIELD OF INVENTION

The invention relates to an alarm clock, more particularly to an alarm clock with a snooze feature which alarm clock includes a switch button assembly which is simple in construction and is easy to manufacture.

2. DESCRIPTION OF THE RELATED ART

Alarm clocks can be set to provide an alarm signal at a predetermined time. Most alarm clocks are provided with a snooze feature which permits the generation of a second alarm signal shortly after the first alarm signal is stopped. The alarm clock further includes a switch button assembly, operation of which can stop the alarm permanently or permits the alarm clock to generate a second alarm after a predetermined time interval.

FIG. 1 shows an exploded view of a conventional alarm clock with a snooze feature. The alarm clock includes a casing (13) with an alarm generating mechanism (14) which is mounted therein and which is operable so as to generate a first alarm at a preset time. The alarm generating mechanism (14) further includes a spring-loaded lever (15) which can be operated by a switch button assembly in a first way to stop the alarm completely or in a second way different from the first way so as to stop the alarm for a predetermined time interval. Since the alarm generating mechanism also includes a snooze feature, a second alarm is generated after the predetermined time interval has elapsed after the first alarm is stopped. The switch button assembly includes first and second circular plates (11, 12). As can be seen from the illustration, the first plate (11) is pivotally mounted in the opening (131) of the casing (13). The first plate (11) includes an arched groove (111) formed along the periphery thereof, a central hole (110) and a plurality of claw-like members (112) extending downward from the periphery of the central hole (110). The second plate (12) includes a central shaft (122) with a latch (123) slidably inserted into the central hole (110) of the first plate (11) so as to engage with the first plate (11). The second plate (12) further includes a projection (121) extending into the arched groove (111) of the first plate (11) and being movable therein when the second plate (12) is rotated relative to the first plate (11). The combined button assembly is biased upward by a spring-loaded lever (15) of the alarm generating mechanism (14) such that it protrudes out from the casing (13). The switch button assembly can be compressed so as to stop the alarm. When the user wishes to stop the alarm permanently, he or she can rotate the second plate (12) relative to the first plate (11), thereby moving the projection (121) of the second plate (12) in the arched groove (111) of the first plate (11) to engage another projection (132) which extends from a side wall of the casing (13) into the interior of the same.

FIG. 2 shows another conventional alarm clock which includes a casing (21) having an alarm generating mechanism (22) provided therein, a spring-loaded frame (25) with two projections (251) mounted on the alarm generating mechanism (22) and a switch button assembly for compressing the spring-loaded frame (25). The alarm generating mechanism (22) further includes an actuating end (252) protruding therefrom. The actuating end (252) can be compressed to contact another terminal (253) of the alarm generating mechanism (22), thereby stopping the alarm. The switch button assembly includes a first plate (8) provided in a slot (D2) of the casing (21). The first plate (8) is substantially thick with a curved upper edge, a horizontal lower edge and a sectoral recess (81) extending from the curved upper edge. A curved groove (84) is formed through the sectoral recess (81). An arched recess (82) extends from the free ends of the horizontal edge, coinciding with the sectoral recess (81). The arched recess (82) has a stop member (83) formed therein. The first plate (8) further includes a second portion (86) extending rearwardly and having a length equal to the thickness of the alarm generating mechanism (22) and a third portion (85) extending substantially perpendicularly therefrom and formed with a pair of mounting holes (851). A second plate (2), which is a thickness equal to the depth of the sectoral recess (81), has a curved upper edge with serration (25), a pair of latches (27) and two arms (26) laterally extending from the bottom end of the second plate (2). Each arm has a protrusion (23, 24) with a different orientation. Once assembled, the second plate (2) is in the sectoral recess (81), the latches (25) slidably engage the curved groove (84), the arms (26) are in the arched groove, and the upper curved edge of the second plate (2) slightly protrudes from the sectoral recess (81) of the first plate (8). Under this condition, the projections (251) of the frame (25) extend into the mounting holes (851). Thus, the combined switch button assembly can be pressed, moving the actuating end (252) to abut the terminal (253) of the alarm circuit, thereby stopping the alarm. When the user wishes to stop the alarm permanently, he or she can slide the latch (27) of the second plate (2) in the curved groove (84) wherein the first plate (8) can be compressed such that the projection (24) of the second plate (2) engages with a protrusion (211) of the casing (21).

A main drawback of the conventional alarm clocks is that the construction of the switch button assemblies are complicated and therefore the manufacturing cost is relatively high.

SUMMARY OF THE INVENTION

The main object of the present invention is to provide an alarm clock with a snooze feature which alarm clock includes a switch button assembly which is simple in construction and which is easy to produce, thereby resulting in a lower manufacturing cost.

According to the present invention, the alarm clock includes a casing defined by a lower half with a bottom, an upper half and a peripheral wall interposed between the upper and lower halves and having an alarm generating device which includes: a battery means; an alarm generating unit; a circuit board with a time setting wheel rotatably mounted thereon, a snooze circuit means, a first contact point and a second contact point; a conductive plate; and an alarm actuating switch button assembly. An elongated opening extends through the peripheral wall in a predetermined direction. The bottom of the lower half has an elongated groove which is formed therein adjacent to the elongated opening and which extends in the same direction as that of the elongated opening. The alarm generating unit includes a first terminal connected to a second pole of the battery means. The snooze circuit means includes a first terminal connected the second pole of the battery means. The first contact point of the circuit board is connected to a second terminal of the alarm generating unit. The second contact point of the circuit board is connected to a second end of the snooze circuit means. The time setting wheel moves downward relative to the board upon reaching a preset alarm time. The conductive plate is mounted in the casing and includes a first end connected to the first pole of the battery means, a second end which abuts against the time setting wheel, a third end which connects the first contact point of the circuit board so as to enable the alarm generating means to generate an alarm when the time setting wheel has rotated to the preset alarm time and a fourth end formed adjacent to the second contact point of the circuit board. The alarm can be stopped temporarily or permanently by actuating the snooze circuit means. Actuation of the snooze circuit means is achieved by operating a switch button assembly which includes a lever that is made of a resilient, insulative material and that has a first and second end transversely passing through the elongated opening to extend out of the casing. The lever further includes a pivot portion formed adjacent to the first end thereof with a cross sectional thickness substantially equal to the width of the elongated opening so as to retain the lever pivotally in the elongated opening. The first end of the lever includes an elongated rod disposed above the fourth end of the conductive plate and having a front end and a rear end opposite to the front end. A positioning member extends downward from the elongated rod and into the elongated groove in the bottom of the lower casing half. The elongated rod further includes an insertion piece integrally formed with and substantially parallel to the elongated rod. The lever can slide in the elongated groove between a first position, wherein the first end of the elongated rod is located above the fourth end of the conductive plate and a free end of the insertion piece is disposed between the third end of the conductive plate and the first contact point of the circuit board thereby electrically disconnecting one from the other, and a second position, wherein the free end of the insertion piece moves away from the third end of the conductive plate with the first end of the elongated rod still being above the fourth end of the conductive plate. When the second end of the lever is lifted upward relative to the bottom of the lower casing half, the elongated rod depresses the fourth end of the conductive plate to actuate the snooze circuit means thereby stopping the alarm for a predetermined time interval. The lever can revert to its initial state due to the resilient force of the same when the applied force is removed from the second end of the lever.

BRIEF DESCRIPTION OF THE DRAWING

Other features and advantages of the present invention will become more apparent in the following detailed description, including drawings, all of which show a non-limiting form of the invention, and of which:.

DETAILED DESCRIPTION OF THE PREFERRED EMBODIMENT

Figure 1:
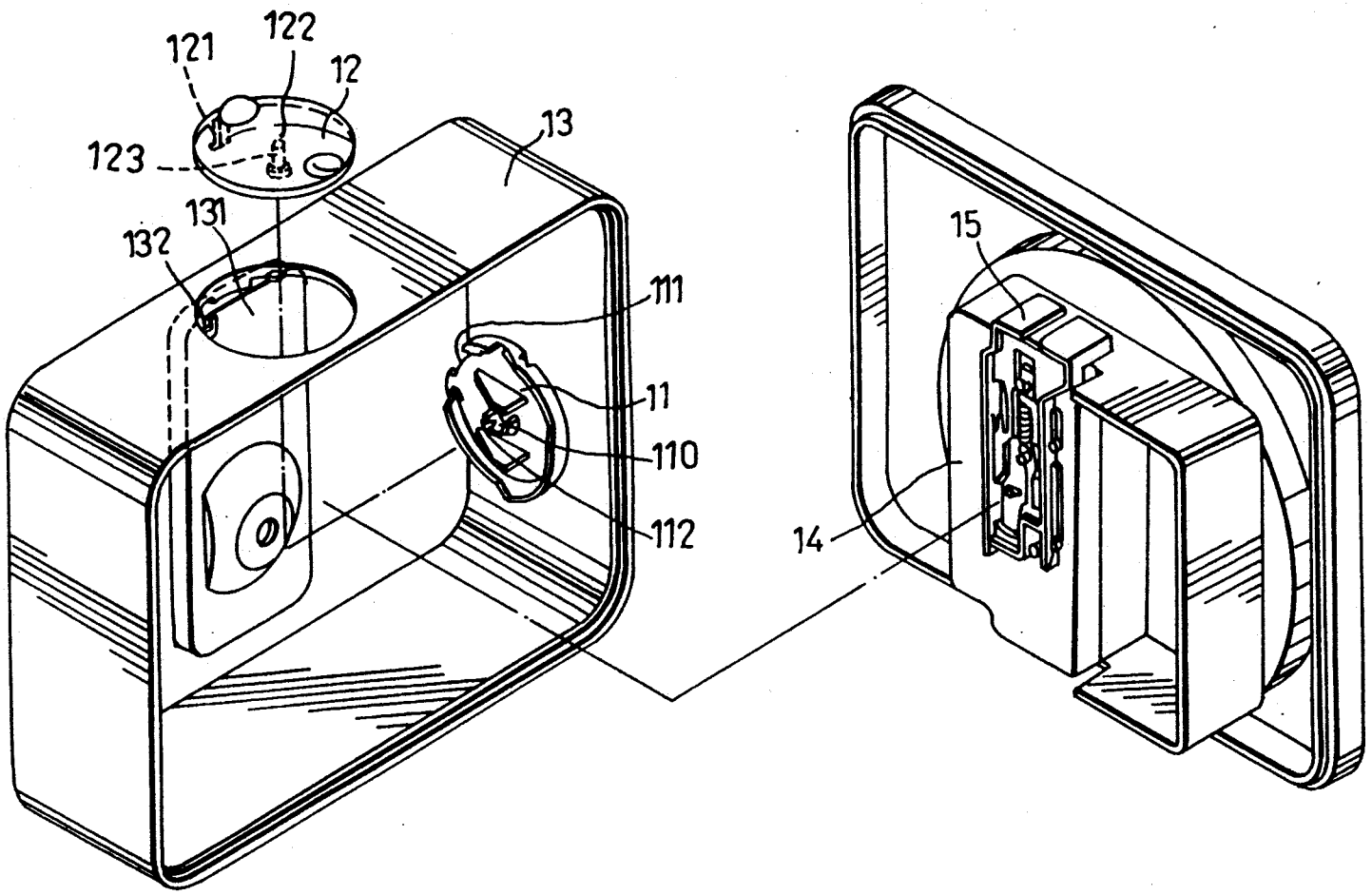
FIG.1 PRIOR ART
FIG. 1 shows an exploded view of a conventional alarm clock with some constitutional parts being removed.
Figure 2:
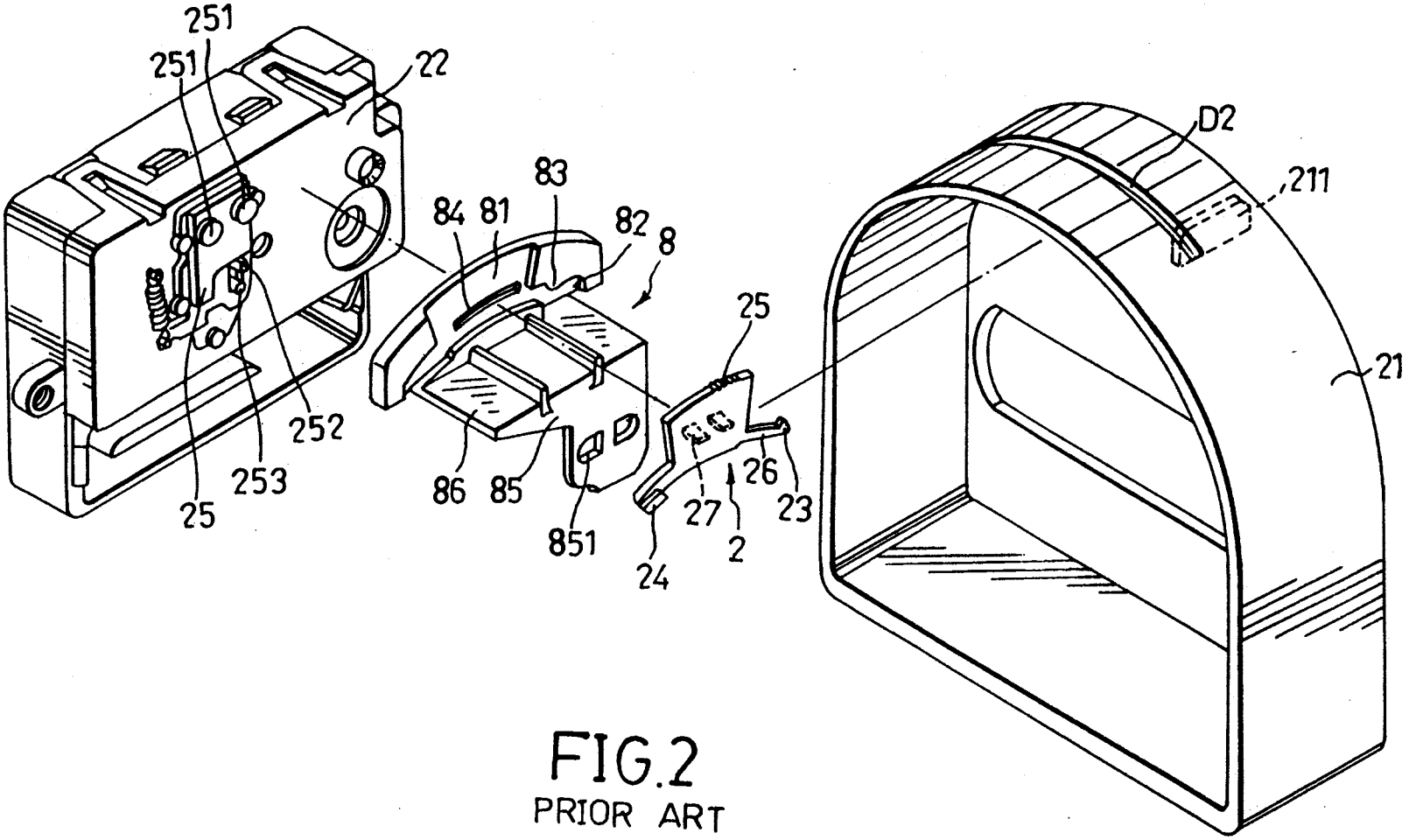
FIG.2 PRIOR ART
FIG. 2 shows an exploded view of another conventional alarm clock with some constitutional parts being removed.
Figure 3:
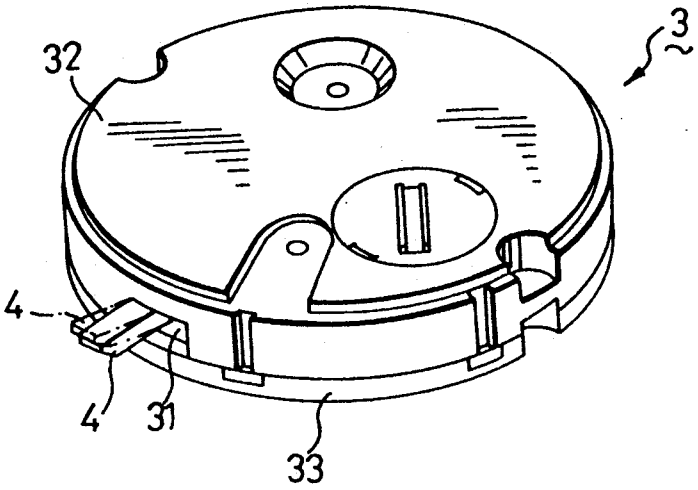
FIG. 3 is a perspective, schematic view of an alarm clock according to the present invention shown without the outer covering.
Figure 4:
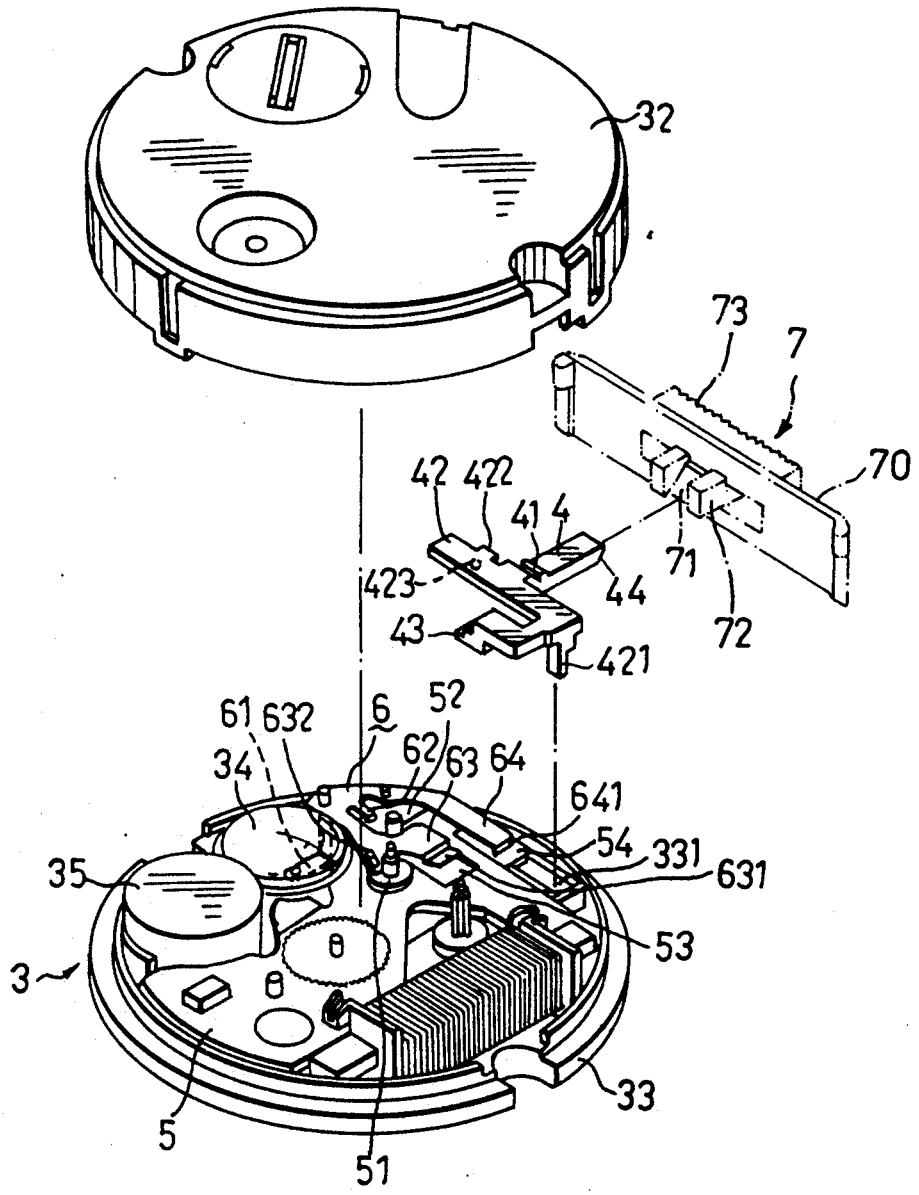
FIG. 4 is an exploded view of the alarm clock of FIG. 3 shown with a switch button assembly which is operated so as to actuate the alarm generating unit of the alarm clock.

Referring to FIGS. 3 and 4, an alarm clock with a snooze feature according to the present invention includes a casing (3) having an upper half (32), a lower half (33) with a flat bottom on which an elongated groove (331) is formed and a peripheral wall interconnecting the upper and lower halves to form said casing. An elongated opening (31) is formed in the peripheral wall and extends in a direction substantially parallel to the elongated groove (331) of the lower half (33).

Since the main object the present invention is to provide a switch button assembly to actuate an alarm device employed in a conventional alarm clock with snooze feature, the other moving mechanisms, such as the "hour" shaft, the "minute" shaft and the connection relationship of these mechanisms with the alarm device will be omitted here.

The alarm device includes a battery means (34) disposed on the bottom of the lower half (33) and having a first and second pole, an alarm generating unit (35) having a first terminal connected to the second pole of the battery means (34), a circuit board (5) having a time setting wheel (51) rotatably mounted on the circuit board (5), a snooze circuit means with two terminals, a first contact point (53) connected to a second terminal of the alarm generating unit (35) and a second contact point (54) connected to one terminal of the snooze circuit.

A conductive plate (6) is mounted in the lower half (33) of the casing (3) and includes a first end (61) connected to the first pole of the battery means (34), a second end (62) connected to a third contact point (52) on the circuit board (5) for supplying power to other electric component of the circuit board, a third end (63) which has a downwardly extending projection (632) abutting with the time setting wheel (51) and an extra portion (631) formed adjacent to the same, a fourth end (64) extending from the conductive plate (6) and adjacent to the third end (63). The extra portion (631) extends upward relative to the third end (63) of the conductive plate (6) and is unable to contact the first contact point (53) of the circuit board (5) when the alarm is not generated. The fourth end (64) of the conductive plate (6) has a pressing portion (641) which is spaced from the second contact point (54) of the circuit board (5).

When the time setting wheel (51) is rotated and has reached a preset alarm time, a change in the position of the time setting wheel (51) causes the extra portion (631) of the third end (63) of the conductive plate (6) to connect with the first contact point (53) of the circuit board (5), thereby causing the alarm generating means to produce an alarm. The operation of the time setting device as used in the present invention has been disclosed in U.S. Pat. No. 5,077,707 issued to Davis Kuo.

Figure 7:
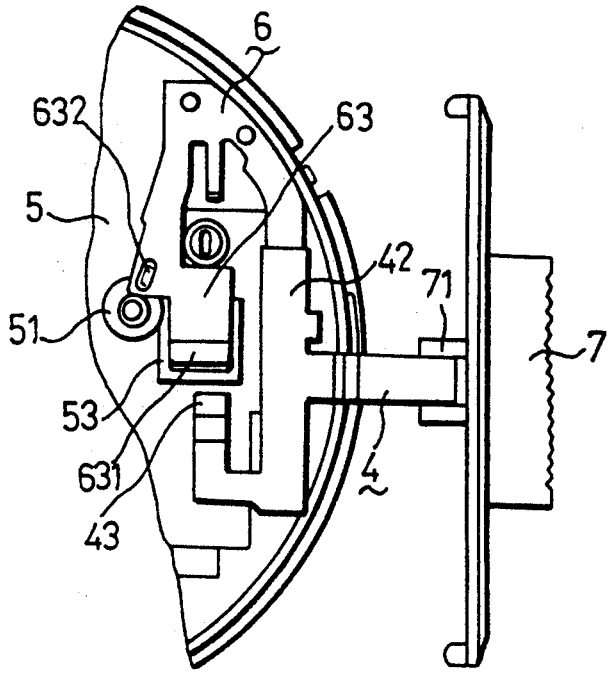
FIG. 7 illustrates the configuration of the switch button assembly of the alarm generating unit and the conductive plate when the switch button assembly is at a first position.

The switch button assembly of the present invention is a lever (4), made of a resilient, insulative material, and includes a first end and a second end transversely passing through the elongated opening (31) of the casing (3). The lever (4) further includes a pivot portion (41) formed adjacent to the first end of the lever (4) and has a thickness substantially equal to a cross sectional width of the elongated opening (31). The lever (4) is retained pivotally in the elongated opening (31). The pivot portion (41) can be a projection which abuts with an upper peripheral edge of the elongated opening (31). The first end of the lever (4) is an elongated depressing rod (42) that includes two positioning members (422, 421) which extend downward into the elongated groove (331) of the bottom of the lower casing (33). The elongated depressing rod (42) further has a stud (423) located at a lower surface thereof and is in constant contact with an upper surface of the fourth end (64) of the conductive plate (6). An insertion piece (43) is formed integrally with and parallely to the elongated rod (42). The insertion piece (43) has a free end substantially bent downward relative to the same, the purpose of which will be explained latter. After the switch button assembly is assembled in the alarm clock, the lever (4) can be moved transversely along the elongated opening (31) between a first position, as shown in FIG. 8, wherein the free end of the insertion piece (43) is below the extra portion (631) of the third end (63) of the conductive plate (6) and a second position, as shown in FIG. 7, wherein the free end of the insertion piece (43) of the lever (4) is spaced from the extra portion (631) of the third end (63) of the conductive plate (6).

Figure 5:
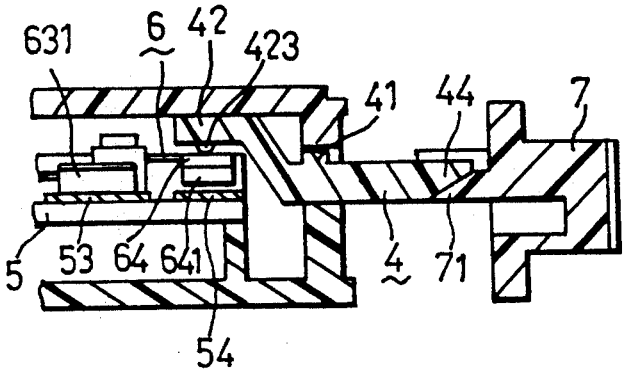
FIG. 5 is a partially cross section view of the alarm clock of FIG. 3, illustrating the configuration of the switch button assembly and the alarm circuit means of the alarm generating unit.
Figure 6:
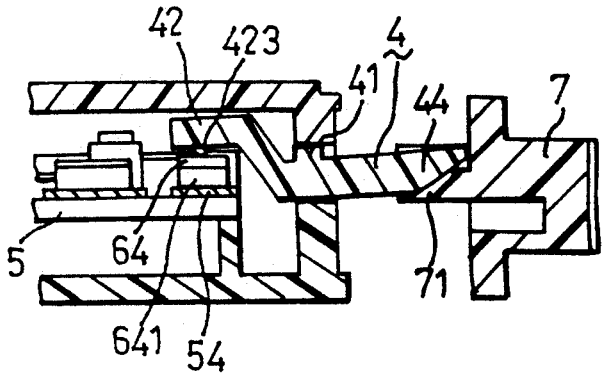
FIG. 6 is a partially cross sectional view of the alarm clock of FIG. 3, illustrating the configuration of the switch button assembly and the alarm circuit means when being actuated.
Figure 8:
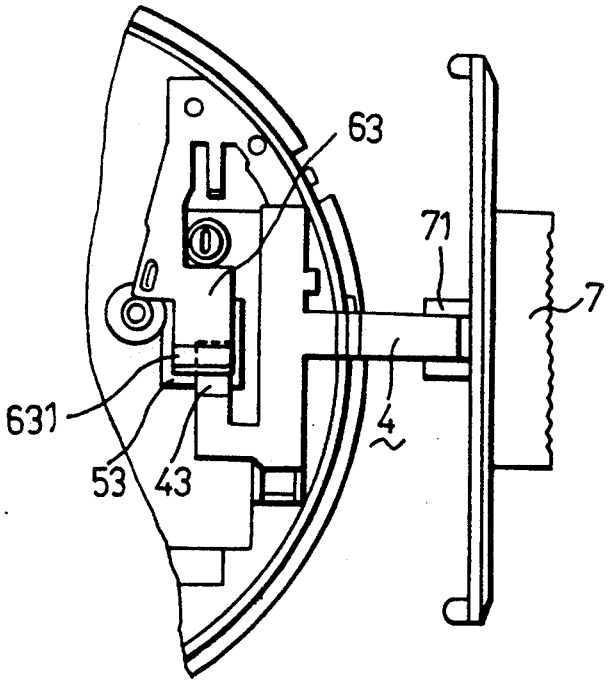
FIG. 8 illustrates the configuration of the switch button assembly of the alarm generating unit and the conductive plate when the switch button assembly is at a second position.

The alarm can be stopped if the lever (4) is moved to the first position, as shown in FIG. 8, wherein the free end of the insertion piece (43) is inserted between the extra portion (631) of the third end (63) of the conductive plate (6) and the first contact point (53) of the circuit board (5) to disconnect the two elements electrically. In order to provide easy insertion of the insertion piece (43), the extra portion (631) of the third end (63) of the conductive plate (6) is curved upward relative to the same so as to define a clearance between the circuit board (5) and the extra portion (631) of the conductive plate (6). Suppose that the user desires to activate the snooze feature of the alarm clock, he or she can lift the lever (4) upward relative to the bottom. The lifting action causes the pressing stud (423) of the elongated depressing rod (42) to depress the fourth end (64) of the conductive plate (6). Thus, the pressing portion (641) of the conductive plate (6) contacts the second contact point (54) of the circuit board (5), as shown in FIG. 6, so that the snooze circuit means is actuated and correspondingly stops the alarm for a predetermined time interval. The lever (4) reverts to its initial position, as shown in FIG. 5, when the applied force at the lever (4) is removed due to the resilient restoration force of the same.

The circuit board (5) with a snooze circuit means used in the present invention is well known in the field of alarm clocks. Therefore, a detailed description of the circuit board (5) will be omitted herein.

Figure 9:
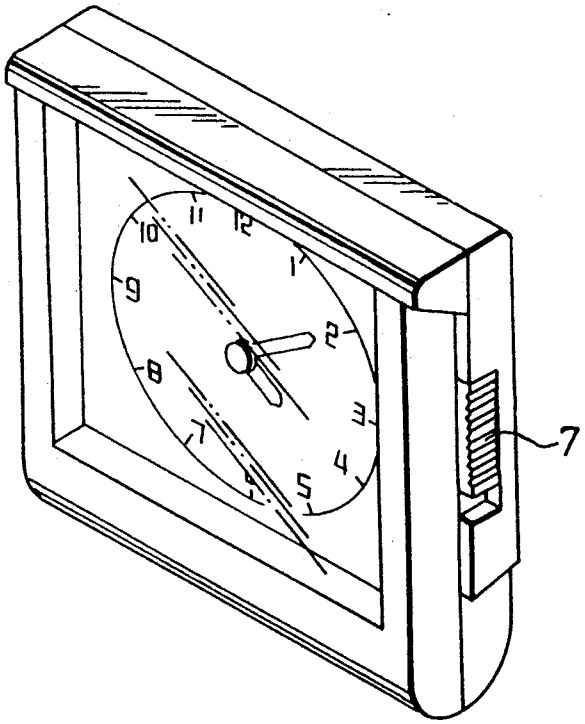
FIG. 9 shows a perspective, schematic view of an alarm clock according to the present invention.

The lever (4) has an inclined free end (44) which abuts an inclined side (71) of a push member (7), a section (73) of which extends out from a covering (not shown) which encloses the casing (3). The push member (7) is slidably disposed in a slot formed on a wall (70) of the covering and includes two studs (72) formed on both sides of the inclined side (71) and which confine the lever (4) securely therebetween. After assembly, the application of a horizontal pushing force on the push member (7) causes the lever (4) to pivot downward relative to the bottom so as to actuate the snooze circuit means, as shown in FIG. 6. The resilient force of the lever (4) is sufficient to restore the push member (7) along the slot in the wall (70) causes the lever (4) to move between the first and second positions. FIG. 9 shows a schematic, perspective view of an alarm clock equipped with the switch button assembly of the present invention.

With the invention thus explained, it is obvious to those skilled in the art that various modifications and variations can be made without departing from the scope and spirit of the present invention. It is therefore, intended that this claims be limited only as in the appended claims.

I claim:

1. An alarm clock comprising:

a casing including a lower half with a bottom and an upper half which cooperates with said lower half to form said casing, said casing having a peripheral wall with an elongated opening formed therethrough and extending in a predetermined direction, said bottom of said lower half having an elongated groove formed therein adjacent to said elongated opening and extending in a direction parallel to said predetermined direction;

a battery means mounted in said casing and having a first and second pole;

an alarm generating means having a first terminal connected to said second pole of said battery means and a second terminal;

a circuit board having a time setting wheel rotatably mounted thereon, a snooze circuit means including a first terminal electrically connected to said second pole of said battery means and a second terminal, a first contact point connected to said second terminal of said alarm generating means, a second contact point connected to said second terminal of said snooze circuit means, said time setting wheel moving downwardly relative to said circuit board upon being rotated to a preset position which corresponds to a preset alarm time;

a conductive plate mounted in said lower half of said casing and having a first end connected to said first pole of said battery means, a second end abutting said time setting wheel, a third end connected to said first contact point of said circuit board so as to enable said alarm generating means to generate an alarm when said time setting wheel has rotated to said preset position, and a fourth end formed adjacent to said second contact point of said circuit board;

a lever made from a resilient, insulative material and having a first end and a second end transversely passing through said elongated opening, said lever having a pivot member formed adjacent to said first end of said lever with a thickness substantially equal to a width of said elongated opening to keep said lever generally parallel to said bottom of said lower half, said first end of said lever moving toward said bottom of said lower half when said second end of said lever is moved upward, said first end of said lever having an elongated depressing portion connected thereto and generally paralleled to said predetermined direction of said elongated opening, said depressing portion having a front portion extending above said fourth end of said conductive plate, and a rear portion opposite to said front portion and a positioning member depending from said depressing portion and which being inserted slidably into said elongated groove of said lower half, said depressing portion having an elongated insertion portion with an end parallely connected to said depressing portion, said lever moving transversely in said elongated opening of said casing between a first position where said front portion of said depressing portion is located above said fourth end of said conductive plate and said end of said insertion portion is located between said third end of said conductive plate and said first contact point of said circuit board to prevent said third end of said conductive plate and said first contact point of said circuit board from being electrically connected to one another, and a second position, wherein said end of said insertion portion is moved away from said third end of said conductive plate, and when said lever is at said second position, lifting of said second end of said lever enabling said elongated depressing portion to move downward and depress said fourth end of said conductive plate so as to depress said second contact point of said circuit board to actuate said snooze circuit means to stop said alarm for a predetermined time interval, said elongated depressing portion of said lever moving upward by a resilient means of said lever after said second end of said lever is released.

2. An alarm clock as defined in claim 1, wherein said second end of said conductive plate has a projection projecting downwardly therefrom to abut said time setting wheel.

3. An alarm clock as defined in claim 1, wherein elongated depressing rod has a stud at said front portion and extending downward from a lower surface of said depressing portion which is in constant contact with said fourth end of said conductive plate when said lever moves transversely in said elongated opening between said first and second positions.

4. An alarm clock as defined in claim 1, wherein: said elongated opening includes an upper peripheral edge and a lower peripheral edge which cooperates with said upper peripheral edge to define said elongated opening; and said pivot member is a projection extending upward therefrom and in contact with said upper peripheral edge of said elongated opening.

* * * * *